United States Patent [19]

Hoffman

[11] Patent Number: 4,691,396

[45] Date of Patent: Sep. 8, 1987

[54] HOLSTER MOUNT

[76] Inventor: Gregory C. Hoffman, 716 Crestview Ct., San Marcos, Calif. 92069

[21] Appl. No.: 941,310

[22] Filed: Dec. 15, 1986

[51] Int. Cl.[4] ..... A47C 21/00; A47F 7/00; A47B 96/06

[52] U.S. Cl. ..... 5/503; 5/508; 211/64; 248/205.1

[58] Field of Search ..... 5/503, 507, 508, 426; 248/205.1; 211/64

[56] References Cited

U.S. PATENT DOCUMENTS

| | | | |
|---|---|---|---|
| 3,009,676 | 4/1961 | Buchwald | 5/503 |
| 4,276,667 | 7/1981 | Osbourne | 5/498 |
| 4,461,442 | 7/1984 | Keenan | 5/503 |
| 4,466,148 | 8/1984 | Jones | 5/503 |
| 4,483,501 | 11/1984 | Eddy | 5/503 |
| 4,521,930 | 6/1985 | Henson | 5/508 |

*Primary Examiner*—Alexander Grosz

*Attorney, Agent, or Firm*—Grant L. Hubbard

[57] ABSTRACT

A mount for supporting a handgun and holster adjacent to the edge of the user's bed comprising a horizontal support plate, a vertical barrier plate extending vertically from the end of the horizontal support plate configured to lie against the outer vertical edge of the mattress, a spacer portion extending outwardly from the upper edge of the vertical barrier plate and a holster mount portion extending upwardly at an angle of about 45 degrees from the outward edge of the spacer portion to receive thereupon a handgun holster is disclosed.

3 Claims, 5 Drawing Figures

HOLSTER MOUNT

FIELD OF THE INVENTION

This invention relates to devices for mounting pistol holsters to the side of a bed for ready access in case of emergency.

BACKGROUND OF THE INVENTION

There is a recognized need for a means to mount a pistol holster to the side of a bed to permit ready access to a pistol received in the holster. In recent years, there have been increasing numbers of incidents of burglars, rapists and other criminals breaking into homes at night and committing serious and violent crimes. Many have concluded that they must provide for their own personal security and have acquired handguns which they keep, variously, in dresser or nightstand drawers, under the mattress, etc. Each of these approaches is fraught with the obvious disadvantage that the protective handgun is not readily available when most needed.

There have been three devices of which I am aware which have sought to address the problem. Henson, U.S. Pat. No. 4,521,930, discloses a pistol mounting bracket which mounts a pistol holster adjacent to the side of the bed by means of a mounting plate in the vertical plane immediately adjacent to the mattress supported by a horizontal plate extending between the mattress and box spring. In some measure, this solves part of the problem in that the pistol is more readily available than in a drawer or under the mattress, etc. The Henson device suffers serious disadvantages, however, in that adequate space is not provided for permitting the user to grip the handgun, the handgun is at an almost inaccessible orientation, and the handgun is likely to become tangled in the bedding. Keenan, U.S. Pat. No. 4,661,442, disclosed a mechanism which tended to orient the handgun for easier access but did not address other serious problems. For example, while it is possible with both the Henson and Keenan devices to extend the support plate only partially under the mattress, there is no means for providing a stop and for assuring that the holster is not turned in an awkward or inaccessible position. Jones, U.S. Pat. No. 4,466,148, disclosed a rather complex mechanism for mounting a pistol on both sides of a bed, having a strap extending across the bed between the mattress and box spring. Jones' mechanism included a removable mount for the holster, but did not address the most serious of the problems involved in this art, namely, assuring that the holster and handgun are readily accessible, properly oriented and spaced from the side of the bed.

The present invention is a holster mount which positions the pistol slightly away from the bed in a firm, fixed and secure manner to enable the user to grip the handle without pinching his thumb against the side of the bed and reducing the risk of grasping bedding along with the handgun, which supports the holster at a readily accessible angle, and which secures the holster in place.

SUMMARY OF THE INVENTION

DESCRIPTION OF THE PREFERRED EMBODIMENT

Figure 1:
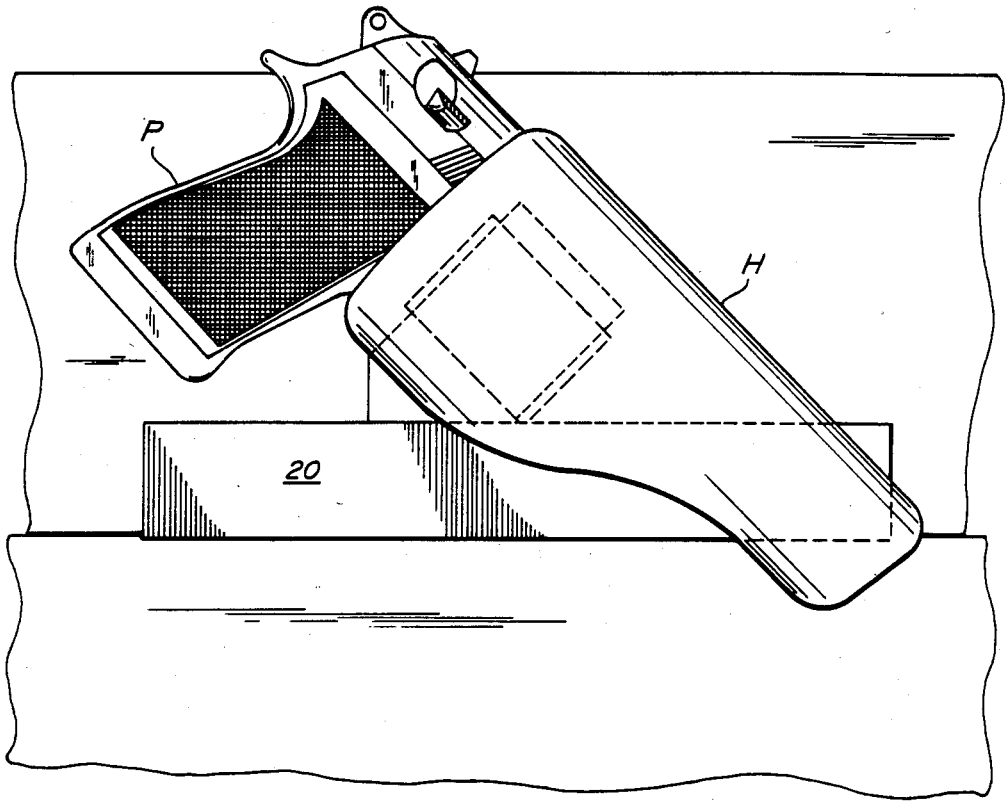
FIG. 1 is a side view of a portion of a bed with the device of this invention mounted for use between the box spring and mattress of a bed and having mounted thereto a holster and a pistol.
Figure 2:
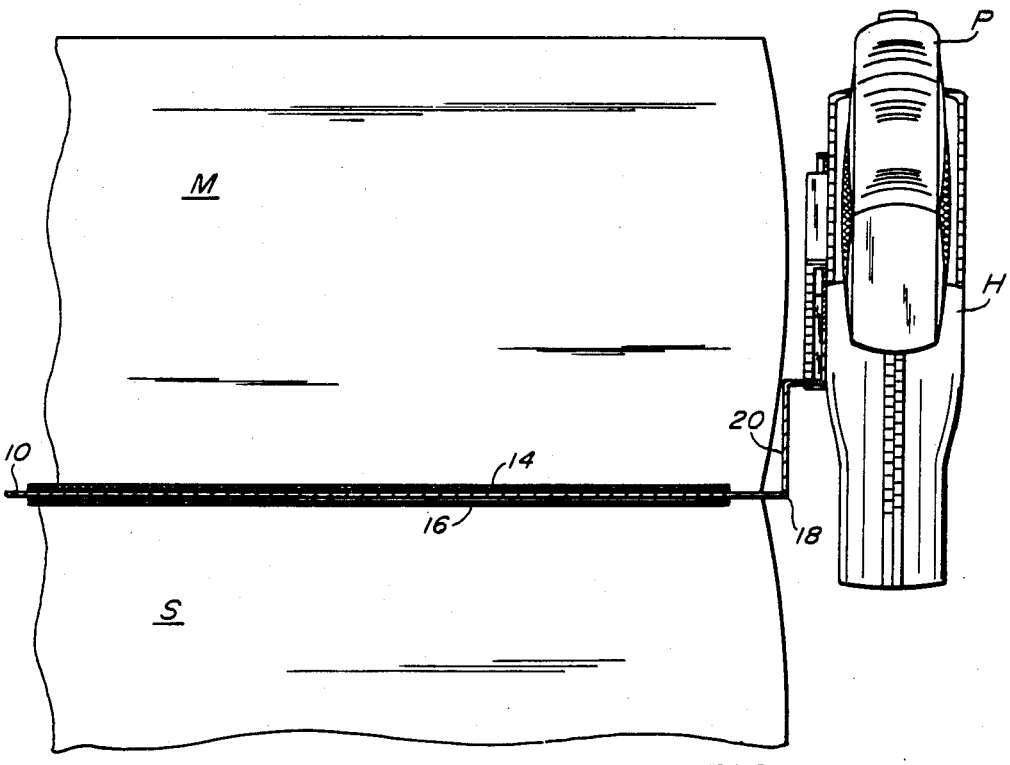
FIG. 2 is a an end view of the device of this invention, i.e., as would be viewed from the end of the bed, showing the structure which positions the pistol holster away from the edge of the bed.
Figure 3:
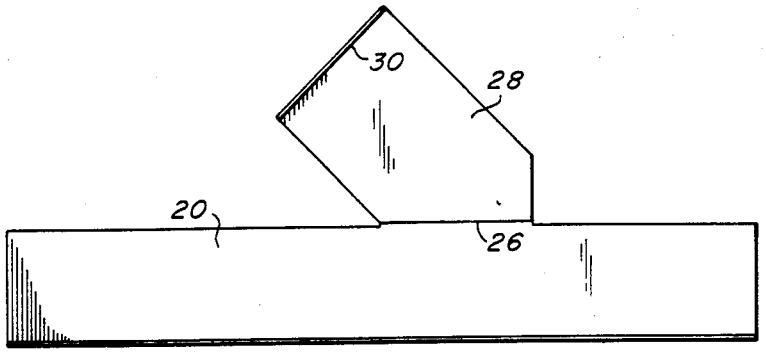
FIG. 3 is a side view of the device of this invention showing the structure which orients the pistol holster, when mounted, for ready access.
Figure 4:
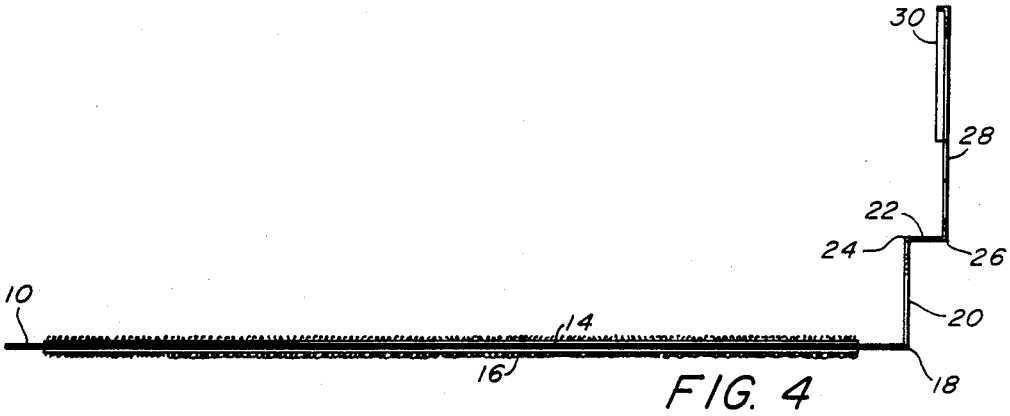
FIG. 4 is an end view in elevation.
Figure 5:
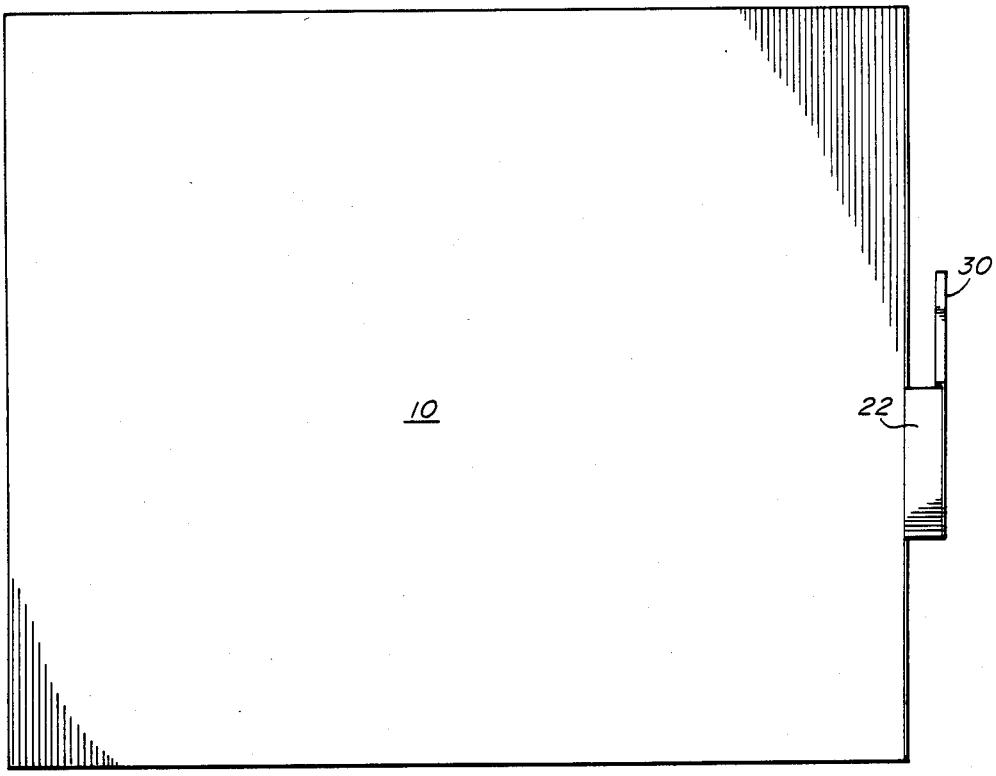
FIG. 5 is a plan view of the invention.

The exemplary embodiment of the invention is intended to depict a particularly preferred embodiment of the invention and not to limit the scope of the invention.

The holster mount mechanism of this invention comprises a horizontal support plate 10 which is constructed and configured to extend several inches between the mattress and box spring of the user's bed. One or more strips or pads of hook-and-loop fastener material 14 and 16 are provided, one portion being attached to the support plate on one or both of the top and bottom sides and one portion being attached to the mattress and to the box springs. Hook-and-loop fasteners, such as sold under the trademark "VELCRO", are easily detached by application of force perpendicular to the plane of the fastening material, but have great resistance to being detached by the application of force in the plane of the fastening material. Hence, it is easy to attach the support plate to the mattress and box spring, or to remove the same, and the weight of the mattress firmly secures the attachment to the bed.

The mount also comprises a vertically extending plate 20 formed by bend 18 which is constructed and configured to lie snugly against the mattress edge for a distance sufficient to assure that the mount does not turn or shift with respect to the edge of the mattress, and to form a barrier cooperating with the holster mount mechanism to assure that the holster and handgun are positioned away from the edge of the bed. Outward extension 22 formed by bend 24 extends perpendicularly outwardly away from the edge of the bed and supports, by bend 26 the holster support bar 28 which extends upwardly parallel to the vertical edge of the bed and at an angle from the vertical toward the head of the bed. The angular orientation of the holster support bar is preferably about 45 degrees, but the exact angle is not critical. Lip 30 extends inwardly a fraction of an inch, typically about one-eighth of an inch, toward the side of the bed and prevents accidental dislodgement of the holster from the side of the bed but permits ready removal when desired.

As depicted in FIG. 1, a holster H containing a handgun such as a pistol P is supported a distance of from about one-fourth to three-fourths of an inch, typically, away from the vertical side of the bed and at an angle of about forty-five degrees from the vertical, angling upwardly toward the head of the bed, placing the pistol in ready reach spaced from the bed and at the proper angle for easy removal of the pistol from the holster. The entire mount, holster and pistol being supported by extension of the support plate between the box spring B and the mattress M.

All, or at least the outwardly extending portion of the mounting device, is formed with smooth edges and may be coated with a heavy vinyl polymer, or other polymer coating to assure that no sharp edges are exposed. A number of plastisol polymer compositions and fluidized bed coating procedures are available for forming a thick, smooth polymeric coating of the type described.

The device depicted is designed to be mounted on the left side of a bed; it being understood, however, that a mirror image of the device mounts in exactly the same manner with the same results on the right side of a bed.

The advantages of the present invention are clear from the structure described and include that advantage that the holster is positioned slightly away from the bed and oriented at an angle of about 45 degrees to enable a person lying in the bed to conveniently grasp the grip of the gun without pinching his thumb and with minimal risk of also grasping bedding. The holster is firmly retained on the mount by the in-turned lip and the mechanism is securely held in the properly spaced position by the upwardly extending plate resting against the edge of the mattress.

The above, and other advantages as well as variations which can be made without departing from the scope of the invention, will be apparent from a careful study of the disclosure.

INDUSTRIAL APPLICATION

The present invention finds application in the home security industry.

What is claimed is:

1. A mount for supporting a handgun and holster adjacent the edge of the user's bed comprising, in combination:

a horizontal support plate having a proximal end adapted to lie adjacent to the edge of the bed and a distal end adapted to lie inwardly therefrom, constructed and configured to extend from the edge of the bed inwardly toward the center of the bed between the mattress and spring of the bed;

a vertical barrier plate extending vertically from the proximal end of the horizontal support plate, constructed and configured to lie against the outer vertical edge of the mattress;

a spacer portion extending outwardly from the upper edge of the vertical barrier plate; and a holster mount portion extending upwardly at an angle of about 45 degrees from the outward edge of the spacer portion, constructed and adapted to receive thereupon a handgun holster.

2. The mount of claim 1 further comprising a lip extending inwardly toward the vertical side of the bed for securing the holster on the holster mount portion.

3. The mount of claim 2 further comprising hook-and-loop fastener means for fastening the horizontal support plate between the spring and the mattress.

* * * * *